US008986180B1

(12) United States Patent
VanBuren et al.

(10) Patent No.: US 8,986,180 B1
(45) Date of Patent: Mar. 24, 2015

(54) PERTURBATION APPARATUS FOR PROPRIOCEPTIVE AND REACTIVE BALANCE TRAINING

(75) Inventors: Jeffrey A. VanBuren, Westerville, OH (US); Javvad Qasimi, Hilliard, OH (US); Chris Relyea, Marysville, OH (US)

(73) Assignee: Balance Dynamix, LLC, Westerville, OH (US)

( * ) Notice: Subject to any disclaimer, the term of this patent is extended or adjusted under 35 U.S.C. 154(b) by 412 days.

(21) Appl. No.: 13/447,190

(22) Filed: Apr. 14, 2012

(51) Int. Cl.
*A63B 22/18* (2006.01)
*A63B 22/16* (2006.01)
*A63B 4/00* (2006.01)

(52) U.S. Cl.
CPC ..... *A63B 4/00* (2013.01)
USPC ..... 482/145; 482/146

(58) Field of Classification Search
USPC ..... 482/146, 139, 141, 123
See application file for complete search history.

(56) References Cited

U.S. PATENT DOCUMENTS

| | | | | | |
|---|---|---|---|---|---|
| 3,593,994 | A | * | 7/1971 | Anbar | 482/147 |
| 3,659,844 | A | * | 5/1972 | Cummins | 482/130 |
| 3,806,116 | A | * | 4/1974 | Malmberg et al. | 482/147 |
| 4,183,521 | A | * | 1/1980 | Kroeker | 482/146 |
| 4,252,312 | A | | 2/1981 | Dehan | |
| 4,291,873 | A | * | 9/1981 | Lee et al. | 482/147 |
| 4,305,579 | A | | 12/1981 | Rice | |
| 4,332,405 | A | | 6/1982 | Lawrason, Sr. | |
| 4,436,513 | A | | 3/1984 | Darby | |
| 4,638,996 | A | * | 1/1987 | Simjian | 482/147 |
| 4,653,748 | A | | 3/1987 | Seel et al. | |
| 4,787,630 | A | | 11/1988 | Watson et al. | |
| 4,986,534 | A | * | 1/1991 | Meier et al. | 482/8 |
| 5,279,533 | A | | 1/1994 | Yin et al. | |
| 5,337,757 | A | | 8/1994 | Jain et al. | |
| 5,399,140 | A | * | 3/1995 | Klippel | 482/146 |
| 5,433,690 | A | * | 7/1995 | Gilman | 482/146 |
| 5,695,439 | A | | 12/1997 | Lin | |
| 5,904,636 | A | | 5/1999 | Chen | |
| 6,461,285 | B1 | | 10/2002 | Theunissen et al. | |
| 6,558,304 | B1 | * | 5/2003 | Bardon et al. | 482/147 |
| D530,374 | S | | 10/2006 | Ng | |
| 7,357,767 | B2 | | 4/2008 | Tsai | |
| 7,374,522 | B2 | * | 5/2008 | Arnold | 482/146 |
| 7,621,861 | B1 | | 11/2009 | Kalember et al. | |
| 7,985,169 | B2 | * | 7/2011 | Tudico | 482/147 |
| 8,435,164 | B2 | * | 5/2013 | VanBuren | 482/145 |
| 2010/0234197 | A1 | * | 9/2010 | Huang et al. | 482/142 |
| 2010/0285941 | A1 | | 11/2010 | Vanburen | |
| 2014/0141950 | A1 | * | 5/2014 | Greiwe | 482/146 |

* cited by examiner

*Primary Examiner* — Stephen Crow
(74) *Attorney, Agent, or Firm* — Ice Miller LLP

(57) ABSTRACT

Disclosed is a portable perturbation device and methods for proprioceptive and reactive balance training and therapy. The perturbation device is manipulated by a user, person other than the user, or mechanical device to impart linear, rotational or tilting movement, or a combination thereof. The device generally comprises a base, a movable assembly positioned on the based and configured to be stood upon by a user. The movable assembly is movable with respect to the base by a manually manipulated assembly connected to the movable assembly. Manipulation of the device may create linear, rotational, or tilting movement, or a combination thereof.

7 Claims, 4 Drawing Sheets

PERTURBATION APPARATUS FOR PROPRIOCEPTIVE AND REACTIVE BALANCE TRAINING

FIELD OF THE INVENTION

The present invention relates to a portable perturbation device for proprioceptive and reactive balance training and therapy.

BACKGROUND OF THE INVENTION

People of all ages receive musculoskeletal injuries when muscles of the foot, ankle, knee and hip do not respond appropriately or quickly enough to stop the motion of the body, or of a particular joint, to prevent injury. Injuries to the lower extremities, such as a foot, ankle, knee, or hip, are among the most common and costly in our society. For example, ankle sprains numbered in excess of 9 million in the U.S. in 2008 and accounted for approximately 20% of all sports injuries. This seemingly simple medical issue generates an estimated $9 billion in office visits, treatment and lost productivity annually in the United States. While this statistic applies to the United States, the problem of lost productivity due to such medical issues is a global problem as well.

Clinical evidence suggests that "functional mobilization," or proprioceptive and reactive balance training generates better outcomes than the alternative treatment approaches, such as conventional physical therapy, immobilization and therapeutic ultrasound. Proprioception is defined as "the unconscious perception of movement and spatial orientation arising from stimuli within the body itself." Reactive balance is a person's ability to respond to a perturbation or unexpected disturbance and maintain their balance. Proprioceptive and reactive balance training can increase a person's endurance, coordination, and proprioception of the foot, ankle, knee and hip muscles. This can be particularly valuable for high level athletes and the elderly who need to rehabilitate an injured joint or wish to prevent future injury. It also has the potential to reduce costs associated with occupational injuries.

Injury prevention via lower extremity proprioceptive and reactive balance training may save society hundreds of millions of dollars in treatment costs and lost productivity. The implications are even greater when one considers the full impact of preventing falls in populations at risk, such as the elderly. Furthermore, perturbation training can generate cost savings in rehabilitation. Proprioceptive training may accelerate return to work by 5 days and return to sports by 9 days. This could save the general U.S. workforce millions of dollars per year and have dramatic financial implications for highly paid professional athletes and performers who rely on their ability to move.

Currently available devices for proprioceptive training do not offer the necessary complexity of motion required for effective proprioceptive training. They typically provide only one type of movement (e.g., lateral or rotational). Furthermore, they do not effectively challenge the patient with the unexpected movement, or perturbation, that is so often the root cause of injury. Rather, the movement of these devices is generated by the patient or generated in a machine-driven, short, repeating pattern. See, e.g., U.S. Pat. No. 5,904,636.

For example, one such commercially available device is sold under the trade name "Biomechanical Ankle Platform System (BAPS)." The system includes a platform and a series of pivot balls that are attached to the bottom of the platform. In operation, the user selects one or more pivot balls to attach to the platform and then the user performs exercises on the platform. All movement of the device is, thus, generated by the user. See also, U.S. Pat. Nos. 4,653,748; and 7,621,861. Devices of this type do not address the need for the user to respond to unexpected motion or perturbation which, as noted above, is often the cause of injury. A number of patents disclose rotational devices including elastic handles for the user to pull for exercising the arms and providing a more rigorous workout. These devices suffer from the same disadvantage that the user controls the motion of the device. See, e.g., U.S. Pat. Nos. 3,593,994; 6,461,285; 4,787,630; 4,332,405; and 5,279,533.

Another disadvantage of several existing designs is that they include relatively bulky frames for the user to hold on to while performing the exercises. In this regard, see U.S. Pat. Nos. 4,305,579; 5,337,757; 5,695,439; and 7,621,861. A number of devices also are limited in their range of motion because they are designed to mimic a given activity, such as surfing, skiing, sail boarding and skateboarding. See, U.S. Pat. Nos. 5,904,636; 4,252,312; 4,436,513; 7,357,767; and U.S. Pat. No. D530,374.

Many physical therapists prefer lighter, less bulky frames and equipment, especially when they are required to move from location to location to visit patients. They prefer to move the equipment within their own workspace and also prefer to bring the equipment to the patient in some instances. It is important to many physical therapists to have the functionality of reactive balance training equipment in a portable, light weight and affordable device.

In view of the disadvantages of existing devices, a need exists for more effective proprioceptive training that provides complexity of movement and challenges the patient with unexpected movement. One such apparatus is described in United States Application Publication No. 2010/0285941 which is hereby incorporated by reference in its entirety.

SUMMARY OF THE INVENTION

The present invention addresses perturbation apparatus and methods that provide desired complexity of motion while challenging a user with unexpected motion. The apparatus generally comprises a portable perturbation training and therapy device. The device may be manipulated by the user, by a person other than the user, or by a mechanical device. The device includes a generally stationary base, a movable assembly within the base on which the user stands, and an assembly connected to the movable assembly which is manipulated by the user, a person other than the user, or by mechanical means to effect movement of the movable assembly. Such movement may be linear, rotational, or linear and rotational, which creates two-dimensional motion. An optional user configurable attachment assembly may be provided to change the angle, acceleration rate, speed, direction and timing of the movement challenges posed to the user by the device. The assembly may include, for example, a platform to which are fastened one or more hemispherical attachments. Either or both of the assembly on which the user stands and the optional user configurable attachment assembly may also include non-skid surfaces and positioning grids. The use of the platform in conjunction with the device creates a three dimensional motion, which is advantageous in treating reactive balance. Such movement mimics real-world objects and situations in which the body is subject to such movement. This is one of the advantages of the present invention over much of the prior art.

In general terms, the invention includes a portable perturbation device for proprioceptive and reactive balance training and therapy, comprising: (a) a generally stationary base having a base upper surface and a base sidewall extending upwardly from the outer edge of the base upper surface and defining a cavity; (b) a moveable assembly configured to be positioned on the base upper surface within the cavity and having a generally horizontal surface configured to be stood upon by a user, the movable assembly being linearly and/or rotatably movable with respect to the base; (c) a manipulable assembly connected to the movable assembly and configured for manipulation by a manipulation means to effect movement of the movable assembly; and (d) an linear movement adjustment device wherein the adjustment device restricts linear movement of the movable assembly with respect to the base.

In one embodiment, the manipulable assembly is manipulated by means selected from the group consisting of the user, a person other than the user, or a mechanical driver.

In another embodiment, the generally horizontal surface configured to be stood upon by a user includes a non-skid surface. The non-skid surface is intended to increase friction between the user and the device. Preferably, it may limit unwanted shifting or sliding of the user's feet or other body part that is in contact with the horizontal surface when the device is in use. The non-skid surface may include a textured surface of the horizontal, a coating deposited on the horizontal surface or a sheet comprising a non-skid surface adhered to the horizontal surface.

Similarly, the invention includes an embodiment wherein the generally horizontal surface configured to be stood upon by a user includes a positioning grid. The positioning grid may comprise a pattern that allows the user or another person to determine the user's position atop the horizontal surface. The positioning grid may comprise a recessed pattern on the generally horizontal surface or it may comprise a sheet containing a positioning grid adhered to the horizontal surface. The positioning grid may further be printed on to the horizontal surface.

The present invention also includes a portable perturbation device for proprioceptive and reactive balance training and therapy further comprising a user configurable attachment assembly positionable atop the movable assembly and comprising: (a) a generally circular attachment plate having a top and bottom surface; (b) a plurality of hemispherical pieces; (c) a fastening system for selectively, removably attaching one or more of the hemispherical pieces to the attachment plate; and (d) a positioning plate configured to rest atop the movable assembly and including a plurality of apertures in geometric, correspondence with the one or more hemispherical pieces when attached to the attachment plate by the fastening system.

In one embodiment, the top surface of the attachment plate includes a non-skid surface. The non-skid surface is intended to increase friction between the user and the device. Preferably, it may limit unwanted shifting or sliding of the user's feet or other body part that is in contact with the horizontal surface when the device is in use. The non-skid surface may include a textured surface of the horizontal, a coating deposited on the horizontal surface or a sheet comprising a non-skid surface adhered to the horizontal surface.

Similarly, in another embodiment, the top surface of the positioning plate includes a positioning grid. The positioning grid may comprise a pattern that allows the user or another person to determine the user's position atop the top surface. The positioning grid may comprise a recessed pattern on the top surface or it may comprise a sheet containing a positioning grid adhered to the top surface. The positioning grid may further be printed on to the top surface.

The present invention also includes a portable perturbation device for proprioceptive and reactive balance training and therapy, wherein the manipulated assembly comprises a removably attached handle connected to the moveable assembly.

Additionally, in one embodiment, the handle is configured to be generally rigid and the handle is hingedly and removably attached to the second portion. Preferably, the handle is hingedly and removable attached through a quick release system, allowing the operator to detach the handle from the moveable assembly when the handle is disposed at a certain angle to the second portion. More preferably, the handle may be detached when the handle is disposed at an angle of 45 degrees from the second portion. The moveable assembly may comprise a handle docking portion having a linear slot. The handle portion may comprise two side members between which a linear bridge portion is disposed. Preferably, the linear bridge portion cooperates with the linear slot of the handle docking portion such that the linear bridge portion may be inserted into the linear slot when the handle is disposed at 45 degrees to the second portion. Once rotated further toward or away from the second portion, the width of the linear bridge portion prohibits the linear bridge portion from being removed from the linear slot.

The present invention also includes a portable perturbation device for proprioceptive and reactive balance training and therapy, wherein the moveable assembly comprises: (a) a ring having a plurality of apertures and being positioned within the base cavity; (b) a plurality of ball bearings positioned within the plurality of apertures of the ring; (c) a cover portion with an upper surface and a lower surface wherein the lower surface rests atop the plurality of ball bearings.

The present invention also includes an embodiment wherein the linear movement adjustment device comprises: (a) a first disc having an upper surface, a lower surface, and at least one slot extending through the first disc; (b) a second disc having an upper surface, a lower surface, having at least one aperture extending through the second disc, wherein the first disc lower surface faces the second disc upper surface and wherein the first disc is rotatable with respect to the second disc; (c) at least one adjustment ring having an upper surface and lower surface and positioned below the second disc such that the upper surface of the adjustment ring faces the lower surface of the second disc; (d) at least one pin inserted through the first disc, such that when the first disc is rotated with respect to the second disc such that the pin is aligned with the aperture, the pin is pushed through the aperture by a spring force so as to cause the pin to engage the upper surface of the adjustment ring and push the adjustment ring downward.

The present invention also includes a method for providing proprioceptive and reactive balance training and therapy to a user, comprising the steps of: (a) providing a perturbation device capable of linear and/or rotational movement and manipulated by a mechanical driver; (b) providing a user configurable attachment system capable of tilting movement; (c) configuring the user configurable attachment system for the user; (d) positioning the user on the user configurable attachment system on the perturbation device; and (e) operating the mechanical driver to effect the linear, rotational, and tilting movement. The mechanical driver may comprise a programmable device or may include a controller with which the user or another person may control the movement of the perturbation device.

DETAILED DESCRIPTION OF THE PREFERRED EMBODIMENTS

The present invention provides an improved device and methods for conducting therapy for ankle, knee and hip stability and range of motion, as well as for the vestibular system. One of the central advantages of the manually or mechanically manipulated perturbation device, referred to as a therapeutic rolling platform system, is its ability to offer users and therapists a training experience that is more effective than those that can be achieved through use of products currently available on the market. Specifically, the device provides the ability for the user or a person other than the user to manually manipulate the angle, acceleration rate, speed, direction and timing of the perturbations posed to the user by the device. It also provides the ability for mechanical manipulation of the angle, acceleration rate, speed, direction and timing of the perturbations posed to the user by the device. The device allows for simultaneous provision of rotational and linear perturbation challenges in unique combinations. The device also enables adjustment of the range of movement, so as to optimize safety and efficacy for the individual needs of each user. The device also is relatively lightweight and portable so that it may easily be moved and transported, for example, by a therapist.

Figure 1:
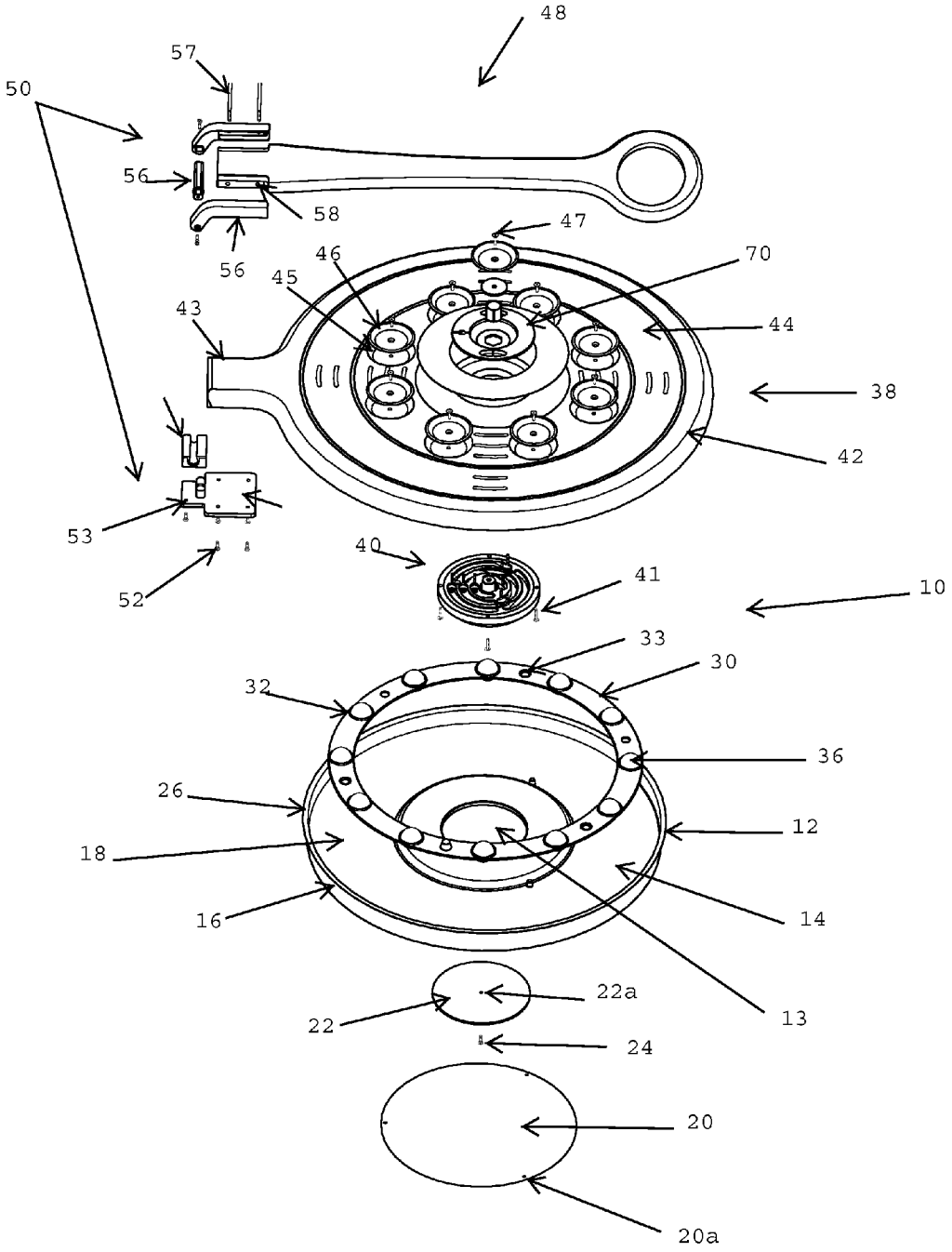
FIG. 1 is an exploded view of one embodiment of the perturbation device of the invention.

FIG. 1 illustrates an exploded view of one embodiment of the perturbation device 10 for proprioceptive and reactive balance training and therapy, which provides the above-described advantages. After describing the individual components, the assembly of the device will be discussed in greater detail. Starting near the bottom of the figure and moving upward, perturbation device 10 is seen to include a base 12 including a generally circular disk with base aperture 13 and having a bottom surface (not-shown) that rests on the floor and an upper surface 14. A sidewall, 16, is seen to circumscribe the disk of base 12 to form a cavity shown generally at 18. Base 12 may be formed from any material that provides the structural integrity needed to support a user's weight, such as wood, metal, polymeric material, and the like, or any combination thereof. The material of base 12 also should be selected to provide for smooth spherical ball rolling as will be described below. Sidewall 16 includes an upper edge, 26. FIG. 1 further shows base cover 20 having fastener openings 20*a*, aperture cover 22 having a fastener opening 22*a*, and base fastener 24.

Shown above base 12 is a first or bearing ring, 30. Ring 30 includes a plurality of bearing apertures indicated generally at 32, which are located in a given geometrical configuration and extend through ring 30. Ring 30 also includes a plurality of apertures 33. This configuration is for illustrative purposes only as the number and arrangement of these apertures may vary. Located within bearing apertures 32 is a plurality of ball bearings 36. Each of the ball bearings is configured to fit within one of the apertures, 32. Each of the apertures 32 has a diameter greater than that of its corresponding ball bearing 36 so that ring 30 is linearly and rotatably movable with respect to base 12.

Moving upward to the next component, device 10 includes a cam adjustment device (or linear adjustment device) 40 having cam fasteners 41. Cam adjustment device 40 is more thoroughly described in FIG. 2.

Looking to the next component, device 10 includes a generally paddle-shaped foot platform, 38, seen to have a circular first portion, 42, and a rectangular portion, 43. Integrally formed with and in the center of portion 42 is a circular platform, 44. Platform 44 includes a plurality of divots 45. Discs 46 are fastened into divots 45 by fasteners 47. Attached to portion 43 is a handle, 48, connected by a hinge, 50. Hinge 50 includes hinge plate 51 which is fastened to rectangular portion 43 by hinge fasteners 52 which insert through hinge fastener openings 53 and fastened into rectangular portion 43. Hinge 50 also includes a hinge slot 54, bridge portion 55, which is attached to hinge side portions 56. Hinge side portions 56 are connected to handle 48 by hinge rods 57, which insert through handle 48 via handle apertures 58. In the preferred embodiment, bridge portion 55 and hinge slot 54 are configured such that the bridge portion may be inserted into the slot when the handle is disposed at a 45 degree angle to the rectangular portion 43. When inserted and rotated away from the rectangular portion, and the perturbation device as a whole, the bridge portion is configured such that the width of the bridge is larger than the width of the slot, preventing the handle from being removed from the handle docking portion.

Figure 4:
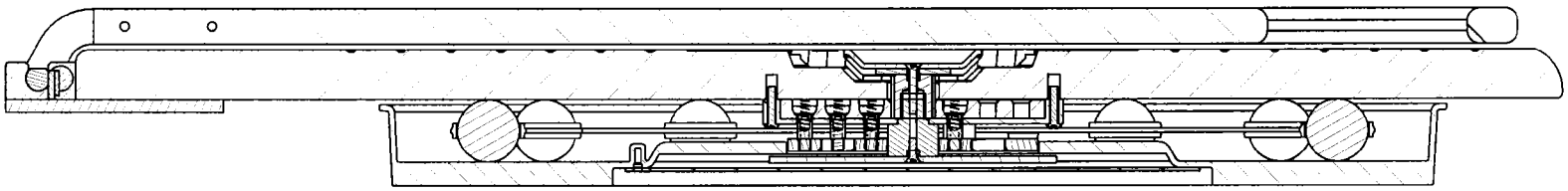
FIG. 4 is a cross section view of one embodiment of the perturbation device of the invention.

Base 12, ring 30, ball bearings 36, and foot platform 38 comprise the main components of device 10. Device 10 is assembled as illustrated in the cross sectional view of FIG. 4 by positioning base 12 on the floor and inserting ring 30 in cavity 18 of base 12. Ball bearings 36 then are positioned within apertures 32 of ring 30. And cam device 41 is inserted and attached to the aperture cover by the base fastener 24. Foot platform 38 then is positioned atop bearings 32 with rectangular portion 42 extending through slot 24 of base 12.

Figure 2:
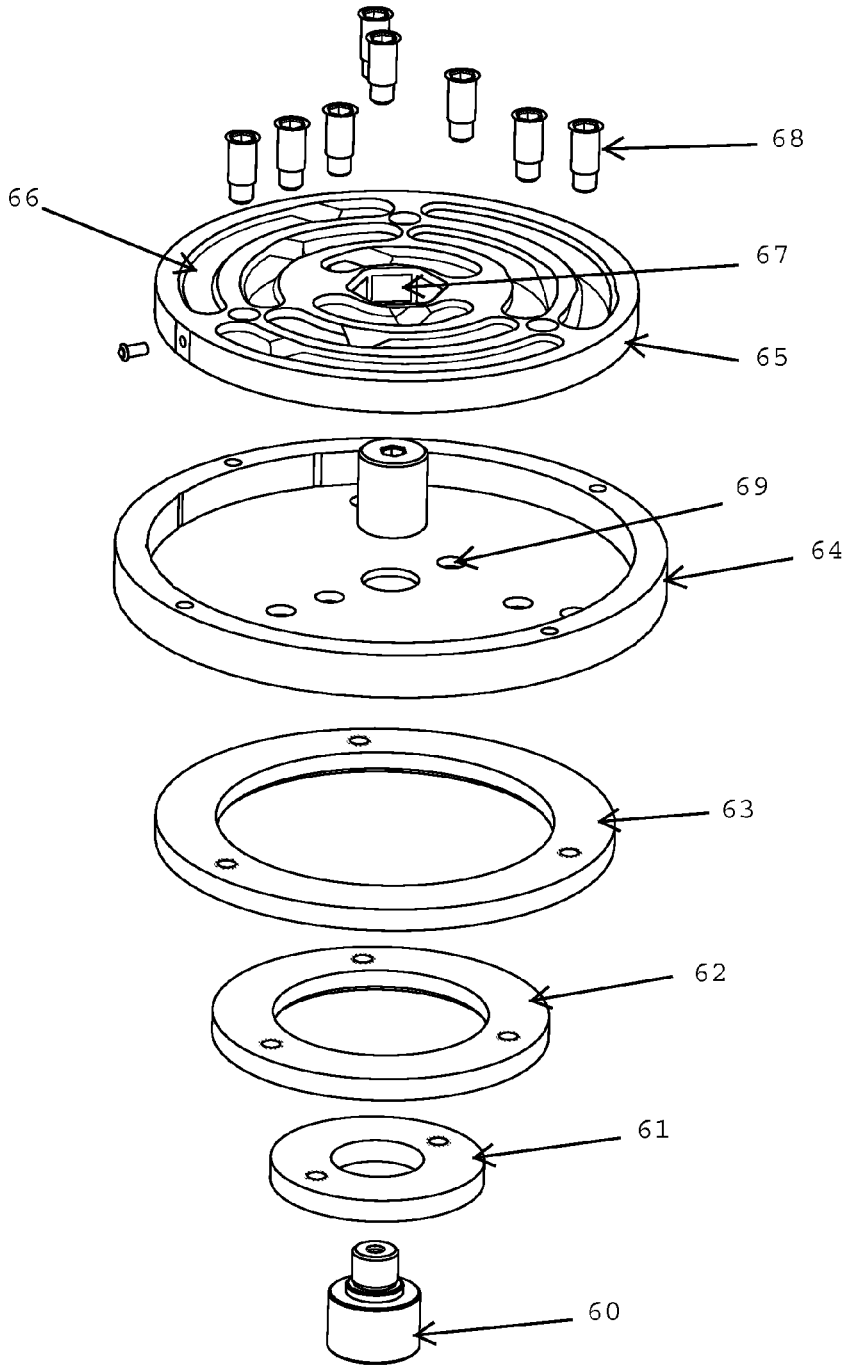
FIG. 2 is an exploded view of the cam adjustment device of one embodiment of the perturbation device of the invention.
Figure 3:
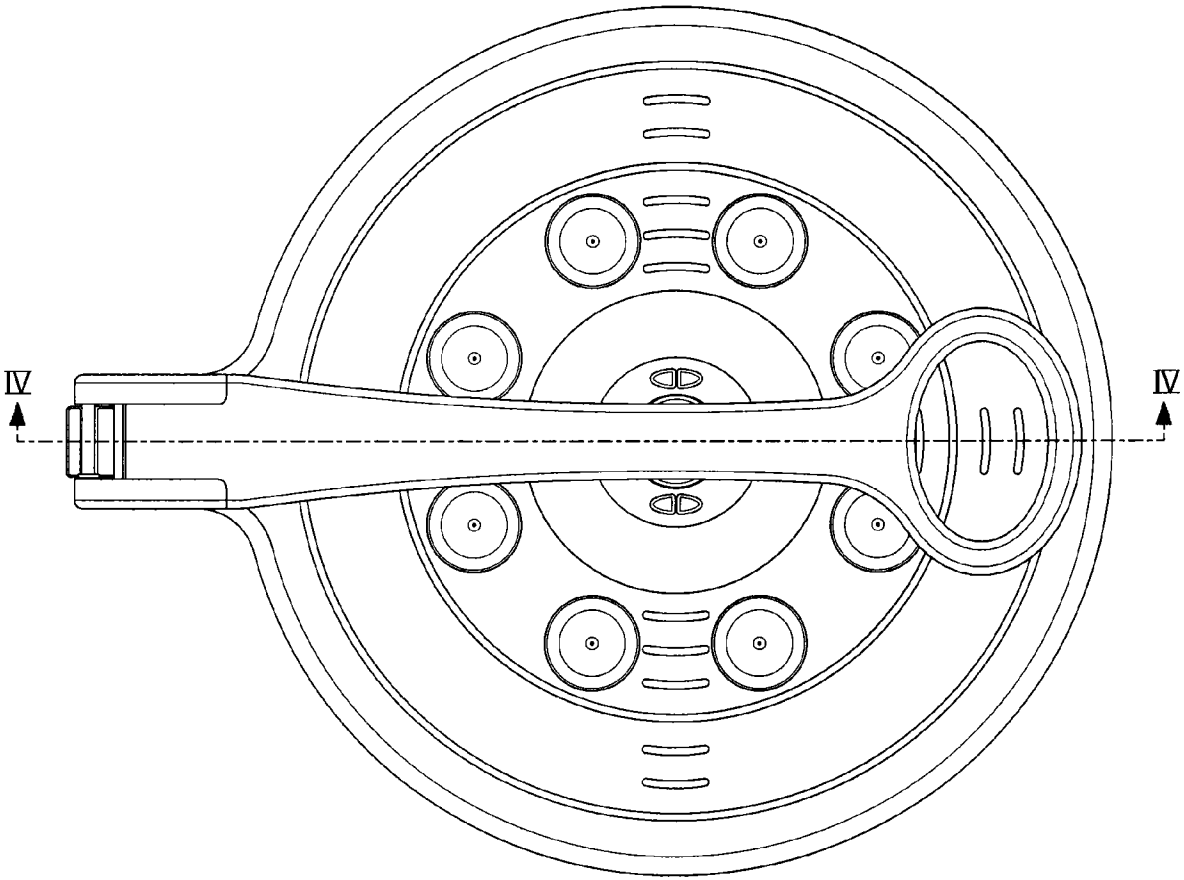
FIG. 3 is a top plan view of one embodiment of the perturbation device of the invention.

FIG. 2 shows an exploded view of cam adjustment device 41. Adjustment device 41 includes fastening component 60, first cam ring 61, second cam ring 62, third cam ring 63, cam base 64, and pin slot disc 65. Pin slot disc 65 includes pin slots 66 arranged in a concentric manner around aperture 67. Cam base 64 includes adjustment apertures 69. Cam adjustment device also includes spring pins 68, which are inserted through pin slots 66. In the preferred embodiment, as disc 65 is rotated manually, the spring pins encounter adjustment apertures 69 at varying intervals. As the spring pins inserted through the pin slots closest to the center of pin slot disc 65 encounter their corresponding adjustment aperture, the pin is pushed through the adjustment aperture and engages first cam ring 61, pushing first cam ring 61 downward into aperture 13 of base 12. Linear movement of ring 30 is thus inhibited to the extent first cam ring 61 encounters the sides of aperture 13. Similarly, as the spring pins moving outward from aperture 67 encounter each of their corresponding adjustment apertures, each pin is pushed through and engages either second cam ring 62 or third cam ring 63. Accordingly, the linear movement of ring 30 within cavity 18 is further inhibited by the increasingly large diameters of each cam ring. Pin slot disc 65 is rotated via the attached rotatable cam disc 70, shown in FIG. 1.

As will be well-understood by one of ordinary skill in the art, all of the components of device 10 may be formed from wood, metal, polymeric material, and the like, or any combination thereof taking into account structural integrity and durability. As will also be well-understood, the various components may be formed having different sizes depending on the user and the training and therapy exercises to be performed. As one example. Ring 30 may be about 26 inches in diameter with a thickness of about one-half inch. The apertures in ring 30 may be about one and one-half inches in diameter. Bearings 36 may be about three-quarters of an inch in diameter. In this embodiment, apertures 32 are all of the same diameter. Ball bearings 36 also are all the same diameter. It will be appreciated that the invention contemplates that the diameter of the apertures and ball bearings may vary with respect to one another so long as the diameter of each ring aperture is greater than the diameter of its corresponding ball hearing. The platform 38 may have a diameter of about 23 and one-half inches and a thickness of about three-quarters of an inch. Rectangular portion 43 may extend outwardly from platform 38 about 8 inches.

Using the device 10, the therapist may provide effective, real-time user-customized proprioceptive training to the user. The user may stand in a single or double leg stance front to back or side to side for the purpose of therapeutic training to the lower extremity and vestibular systems. Using handle 48, the therapist can manually manipulate the angle, acceleration rate, speed, direction and timing of the movement challenges posed to the user by the device. It allows for simultaneous provision of rotational and linear movement challenges in unique combinations. Through selection of the appropriate attachments by the therapist, the device also enables adjustment of the range of movement, so as to optimize safety and efficacy for the individual needs of each user.

In addition to being useful as a perturbation training and therapy device, the apparatus of the invention also has utility as a diagnostic device. Specifically, the therapist can use perturbation device 10 to monitor changes in the patient's proprioception and reactive balance. By evaluating the patient's ability to remain stable while device 10 is in motion over a carefully monitored range of linear distance and rotation, the therapist can assess the extent of injury, progress in therapy, and objectively determine the appropriate time for return to sports or work.

The following description is presented to enable any person skilled in the art to make and use the proprioceptive training apparatus and methods in accordance with embodiments of the invention. Various modifications to the preferred embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. Thus, the present invention is not intended to be limited to the embodiments shown, but is to be accorded the widest scope consistent with the principles and features disclosed herein.

What is claimed is:

1. A portable perturbation device for proprioceptive and reactive balance training and therapy, comprising:

a. a generally stationary base having a base upper surface and a base sidewall extending upwardly from the outer edge of said base upper surface and defining a cavity;

b. a moveable assembly configured to be positioned on said base upper surface within said cavity and having a generally horizontal surface configured to be stood upon by a user, said movable assembly being linearly and rotatably movable with respect to said base;

c. a manipulable assembly connected to said movable assembly and configured for manipulation by a manipulation means to effect movement of said movable assembly; and d. a linear movement adjustment device wherein said adjustment device restricts linear movement of said movable assembly with respect to said base and comprises:

i. a first disc having an upper surface, a lower surface, and at least one slot extending through said first disc;

ii. a second disc having an upper surface, a lower surface, having at least one aperture extending through said second disc, wherein said first disc lower surface faces said second disc upper surface and wherein said first disc is rotatable with respect to said second disc;

iii. at least one adjustment ring having an upper surface and lower surface and positioned below said second disc such that said upper surface of said adjustment ring faces said lower surface of said second disc; and iv. at least one pin inserted through said first disc, such that when said first disc is rotated with respect to said second disc such that said pin is aligned with said aperture, said pin is pushed through said aperture by a spring force such that said pin engages said upper surface of said adjustment ring and pushes said adjustment ring downward.

2. The portable perturbation device for proprioceptive and reactive balance training and therapy of claim 1, wherein said moveable assembly comprises:

a. a ring having a plurality of apertures and being positioned within said base cavity;

b. a plurality of ball bearings positioned within said plurality of apertures of said ring;

c. a cover portion with an upper surface and a lower surface wherein said lower surface rests atop said plurality of ball bearings.

3. The portable perturbation device for proprioceptive and reactive balance training and therapy of claim 1, wherein said manipulable assembly is manipulated by means selected from the group consisting of the user, a person other than the user, or a mechanical driver.

4. The portable perturbation device for proprioceptive and reactive balance training and therapy of claim 1, wherein said generally horizontal surface configured to be stood upon by a user includes a non-skid surface.

5. The portable perturbation device for proprioceptive and reactive balance training and therapy of claim 1, wherein said generally horizontal surface configured to be stood upon by a user includes a positioning grid.

6. The portable perturbation device for proprioceptive and reactive balance training and therapy of claim 1, wherein said manually manipulated assembly comprises a handle removably attached connected to said second portion.

7. The portable perturbation device for proprioceptive and reactive balance training and therapy of claim 1, wherein said handle is configured to be generally rigid and said handle is hingedly attached to said second portion.

* * * * *